US010571112B2

(12) United States Patent
Engberg

(10) Patent No.: US 10,571,112 B2
(45) **Date of Patent: *Feb. 25, 2020**

(54) ROTATING LIGHT EMITTING DIODE HIGH MAST LUMINAIRE

(71) Applicant: CHM Industries, Inc., Irving, TX (US)

(72) Inventor: Scott Engberg, Dallas, TX (US)

(73) Assignee: CHM Industries, Inc., Saginaw, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/292,098

(22) Filed: Mar. 4, 2019

(65) Prior Publication Data

US 2019/0203923 A1 Jul. 4, 2019

Related U.S. Application Data

(63) Continuation of application No. 15/884,597, filed on Jan. 31, 2018, now Pat. No. 10,234,128, which is a (Continued)

(51) Int. Cl.

| | |
|---|---|
| ***F21V 29/76*** | (2015.01) |
| ***F21S 8/08*** | (2006.01) |
| ***F21V 15/01*** | (2006.01) |
| ***F21V 23/00*** | (2015.01) |
| ***F21V 14/02*** | (2006.01) |
| ***F21V 21/14*** | (2006.01) |

(Continued)

(52) U.S. Cl.

CPC ..... *F21V 29/76* (2015.01); *F21S 8/086* (2013.01); *F21V 14/02* (2013.01); *F21V 15/01* (2013.01); *F21V 21/14* (2013.01); *F21V 23/002* (2013.01); *F21V 23/009* (2013.01); *F21W 2131/103* (2013.01); *F21Y 2105/16* (2016.08); *F21Y 2115/10* (2016.08)

(58) Field of Classification Search

CPC ..... F21V 29/76; F21V 14/02; F21V 15/01; F21V 23/002; F21V 23/009; F21S 8/086

See application file for complete search history.

(56) References Cited

U.S. PATENT DOCUMENTS

| | | | |
|---|---|---|---|
| 3,210,531 | A | 10/1965 | Neely et al. |
| 4,937,717 | A | 6/1990 | Betzvog, Jr. |

(Continued)

FOREIGN PATENT DOCUMENTS

| | | |
|---|---|---|
| CA | 2501447 | 5/2014 |
| CN | 201259153 Y | 6/2009 |

(Continued)

OTHER PUBLICATIONS

Article from LEDs Magazine, "Dialight secures orders, introduces 25,000-lumen LED high-bay fixture," Nov. 27, 2012.

(Continued)

*Primary Examiner* — Mary Ellen Bowman

(74) *Attorney, Agent, or Firm* — Foley & Lardner LLP

(57) ABSTRACT

A high mast luminaire includes a power housing that defines an internal space, and a power source is disposed within the internal space. A light emitting diode (LED) housing supports a plurality of LEDs that are powered by the power source, and a plurality of LED cooling fins extend from a back face of the LED housing. An extension member extends from the power housing to the LED housing. The LED housing and the plurality of LED cooling fins are rotatable with respect to the power housing.

30 Claims, 6 Drawing Sheets

Related U.S. Application Data continuation of application No. 15/594,163, filed on May 12, 2017, now Pat. No. 9,903,581, which is a continuation of application No. 14/535,924, filed on Nov. 7, 2014, now Pat. No. 9,677,754.

(51) Int. Cl.

| | |
|---|---|
| ***F21W 131/103*** | (2006.01) |
| ***F21Y 105/16*** | (2016.01) |
| ***F21Y 115/10*** | (2016.01) |

(56) References Cited

U.S. PATENT DOCUMENTS

| | | | |
|---|---|---|---|
| 6,799,864 | B2 | 10/2004 | Bohler et al. |
| 7,204,615 | B2 | 4/2007 | Arik et al. |
| D625,038 | S | 10/2010 | Yoo |
| 8,029,151 | B2 | 10/2011 | Butler |
| 8,070,306 | B2 | 12/2011 | Ruud et al. |
| 8,087,807 | B2 | 1/2012 | Liu et al. |
| 8,118,450 | B2 | 2/2012 | Villard |
| 8,342,714 | B1 | 1/2013 | Rea et al. |
| 8,425,091 | B2 | 4/2013 | Chen |
| 8,567,994 | B2 | 10/2013 | Gang et al. |
| 8,646,944 | B2 | 2/2014 | Villard |
| 8,789,967 | B2 | 7/2014 | Gordin et al. |
| 8,858,026 | B2 | 10/2014 | Lee et al. |
| 9,010,956 | B1 | 4/2015 | Davis |
| 9,109,787 | B2 | 8/2015 | Nankil |
| 9,131,557 | B2 | 9/2015 | Vadai et al. |
| 9,383,508 | B2 | 7/2016 | Getzinger et al. |
| 9,464,790 | B2 | 10/2016 | Badley et al. |
| 9,651,238 | B2 | 5/2017 | Badley |
| 2008/0273330 | A1 | 11/2008 | Tyson |
| 2009/0073688 | A1 | 3/2009 | Patrick |
| 2009/0097262 | A1 | 4/2009 | Zhang et al. |
| 2009/0213588 | A1 | 8/2009 | Manes |
| 2010/0157570 | A1 | 6/2010 | Xiao et al. |
| 2010/0214780 | A1 | 8/2010 | Villard |
| 2010/0315252 | A1 | 12/2010 | Desphande et al. |
| 2010/0315824 | A1 | 12/2010 | Chen |
| 2011/0002124 | A1 | 1/2011 | Chang et al. |
| 2011/0075433 | A1 | 3/2011 | Mart et al. |
| 2011/0204790 | A1 | 8/2011 | Arik et al. |
| 2011/0249427 | A1 | 10/2011 | Rooms et al. |
| 2012/0087118 | A1 | 4/2012 | Bailey et al. |
| 2012/0127727 | A1 | 5/2012 | Wan-Chin et al. |
| 2012/0243231 | A1 | 9/2012 | Vadai et al. |
| 2012/0307484 | A1 | 12/2012 | Lin et al. |
| 2012/0325982 | A1 | 12/2012 | Guercio |
| 2013/0134880 | A1 | 5/2013 | Rea et al. |
| 2013/0148340 | A1 | 6/2013 | Shen |
| 2014/0070731 | A1 | 3/2014 | Chakravarty et al. |
| 2014/0334149 | A1 | 11/2014 | Nolan et al. |
| 2014/0347848 | A1 | 11/2014 | Pisavadia et al. |
| 2015/0362172 | A1 | 12/2015 | Gabriel et al. |
| 2016/0146412 | A1 | 5/2016 | Tubb, Jr. |

FOREIGN PATENT DOCUMENTS

| | | | |
|---|---|---|---|
| CN | 202691697 | U | 6/2012 |
| CN | 102661512 | B | 9/2012 |
| CN | 102748670 | A | 10/2012 |
| CN | 103574387 | A | 2/2014 |
| CN | 203549667 | U | 4/2014 |
| CN | 203703744 | U | 7/2014 |
| DE | 11 20 593 | | 2/1960 |
| DE | 37 19 384 | A1 | 12/1988 |
| DE | 29617628 | U | 12/1996 |
| DE | 20 2006 000 973 | U1 | 6/2006 |
| DE | 10 2007 057 404 | A1 | 5/2009 |
| DE | 20 2009 003 239 | U1 | 7/2009 |
| DE | 10 2008 007 647 | A1 | 8/2009 |
| DE | 10 2008 017 483 | A1 | 10/2009 |
| DE | 20 2009 014 103 | U1 | 3/2010 |
| DE | 10 2011 081 369 | A1 | 2/2013 |
| DE | 10 2012 205 231 | B4 | 10/2013 |
| EP | 1 457 735 | A1 | 9/2004 |
| EP | 2 025 998 | B1 | 1/2011 |
| EP | 2 518 398 | A2 | 10/2012 |
| EP | 2 484 965 | B1 | 5/2017 |
| KR | 100910539 | B1 | 7/2009 |
| KR | 20130056775 | A | 5/2013 |
| KR | 101374250 | B1 | 12/2013 |
| KR | 20140137934 | A | 12/2014 |
| WO | WO-2009/140415 | | 11/2009 |
| WO | WO-2010/035996 | | 4/2010 |
| WO | WO-2010/035996 | A2 | 4/2010 |
| WO | WO-2010/117157 | | 4/2010 |
| WO | WO-2012/159744 | | 11/2012 |
| WO | WO-2013/125875 | | 8/2013 |

OTHER PUBLICATIONS

Brochure, "HMAO LED High Mast Series", Holophane Leader in Lighting Solutions, Acuity Brands, 12 pages, date unknown.
Holophane Infrastructure Speciality: HMLED2\up3\'99 \up0 LED High Mast Lighting, 2010.
Holophane Petrolux\'ae LED Brochure, 2013.
Texas Department of Transportation, Traffic Operations Division, High Mast Illumination Details HMID(1)-03, 9 pages.
TraStar High Bay LED, no date.
"Selecting the best Distribution for you Exterior projects," 3 pages.
Acuity Brands Lighting: LED Important Safety Instructions, 4 pages (Installation Manual).
Acuity Brands: "Las Vegas Convention Center Cuts Energy Consumption by 40% with High Bay Luminaires from Acuity Brands," Apr. 1, 2013, 9 pages.
Acuity Brands: Exhibit A: Holophane Adds LED Technology to Industry-Leading Portfolio of High Mast Lighting Solutions, Jul. 29, 2019, 29 pages.
BAYLED78W/D10/LC, Technical Specifications, 3 pages.
Chen, et al., "Rectangular illumination using a secondary optics with cylindrical lens for LED street light," vol. 21, No. 3, Optics Express 3201, Feb. 11, 2013.
Cooper Industries: Area Roadway, CTN Celesteon McGraw-Edison Area/Site Luminaire, May 6, 2011, 3 pages.
Cree: Cree® XLamp® XT-E LED Streetlight Reference Design, 16 pages.
Cree: LED Luminaire Design Guide, 15 pages.
Cree: S. Durham Water Reclamation Facility, Durham, NC, Energy Savings and Improved Nighttime Visibility, 4 pages.
Datasheet of HiCloud—LED Highbay, Feb. 12, 2014, 4 pages.
Defendant's Amended Preliminary Invalidity Contentions filed Aug. 26, 2019 in U.S.D.C., Northern District of Texas, Dallas Division, Case No. 3:19-Cv-00797-K.
DTDU Installation Instructions for models DTDU-35LED-41-MV, "DTDU LED Dusk-to-Dawn Utility-grade," May 2014, 4 pages.
E40 Module LED Street Light Fixtures—Lampshining, 2014, 2 pages.
E40 Mogul Base LED Street Lights, 2014, 1 page.
Eaton: Installation Instructions-Celesteon LED IB521008EN, 19 pages.
Eaton: Celesteon LED High Mast Luminaire, Jan. 2019, 3 pages.
Eaton: CTN Celesteon, www.cooperindustries.com/content/public/en/lighting/products/area_site_lighting/_945164.html, 2019, 6 pages.
Eaton: McGraw-Edison CTN Celesteon Solid State LED-Area/Site Luminaire, Jun. 28, 2019, 3 pages.
Ecolightech: Slim LED High Bay Light, 2014, 21 pages.
Electrical Review, vol. 243, No. 6, Jun. 2010, 37 pages.
Exhibit A: Invalidity Chart: *U.S. Pat. No. 9,677,754* vs. *HMAO I Brochure*.
Exhibit AA: Invalidity Chart: *U.S. Pat. No. 9,903,581* vs *Hmao II Product*.
Exhibit B: Invalidity Chart: *U.S. Pat. No. 9,677,754* vs *HMAO I Brochure + Lee*.
Exhibit BB: Invalidity Chart: *U.S. Pat. No. 9,903,581* vs. *Qiao + HMAO I Product*.

(56) References Cited

OTHER PUBLICATIONS

Exhibit C: Invalidity Chart: *U.S. Pat. No. 9,677,754* vs *HMAO I Product*.
Exhibit CC: Invalidity Chart: *U.S. Pat. No. 9,903,581* vs *Shi + HMAO I Product*.
Exhibit D: Invalidity Chart: *U.S. Pat. No. 9,677,754* vs *HMAO I Product + Lee*.
Exhibit DD: Invalidity Chart: *U.S. Pat. No. 9,677,754* vs *CTN Celesteon Product*.
Exhibit E: Invalidity Chart: *U.S. Pat. No. 9,677,754* vs. *Villard*.
Exhibit EE: Invalidity Chart: *U.S. Pat. No. 9,677,754* vs *TSHB Product + CTN Celesteon Product*.
Exhibit F: Invalidity Chart: *U.S. Pat. No. 9,677,754* vs. *Villard + HMAO I Brochure*.
Exhibit FF: Invalidity Chart: *U.S. Pat. No. 9,903,581* vs. *CTN Celesteon Product*.
Exhibit G: Invalidity Chart: *U.S. Pat. No. 9,677,754* vs. *Villard + HMAO I Product*.
Exhibit H: Invalidity Chart: *U.S. Pat. No. 9,677,754* vs *Yoo*.
Exhibit I: Invalidity Chart: *U.S. Pat. No. 9,677,754* vs. *Yoo + Villard*.
Exhibit J: Invalidity Chart: *U.S. Pat. No. 9,677,754* vs. *Yoo + HMAO I Products*.
Exhibit K: Invalidity Chart: *U.S. Pat. No. 9,677,754* vs. *TSHB Product*.
Exhibit L: Invalidity Chart: *U.S. Pat. No. 9,677,754* vs. *TSHB Product + HMAO I Product*.
Exhibit M: Invalidity Chart: *U.S. Pat. No. 9,677,754* vs. *Qiao and HMAO I Product*.
Exhibit N: Invalidity Chart: *U.S. Pat. No. 9,677,754* vs. *Lumark Product*.
Exhibit O: Invalidity Chart: *U.S. Pat. No. 9,677,754* vs. *Lumark Product + HMAO I Product*.
Exhibit P: Invalidity Chart: *U.S. Pat. No. 9,677,754* vs. *Shi and HMAO I Product*.
Exhibit Q: Invalidity Chart: *U.S. Pat. No. 9,677,754* vs. *HMAO II Product*.
Exhibit R: Invalidity Chart: *U.S. Pat. No. 9,677,754* vs. *HMAO I Product + Lee + TSHB*.
Exhibit S: Invalidity Chart: *U.S. Pat. No. 9,677,754* vs. *Qiao + HMAO I Product + TSHB Product*.
Exhibit T: Invalidity Chart: *U.S. Pat. No. 9,677,754* vs. *Shi + HMAO I Product + TSHB Product*.
Exhibit U: Invalidity Chart: *U.S. Pat. No. 9,903,581* vs. *HMAO I Product*.
Exhibit V: Invalidity Chart: *U.S. Pat. No. 9,903,581* vs. *HMAO I Product + Lee*.
Exhibit W: Invalidity Chart: *U.S. Pat. No. 9,903,581* vs. *Yoo + HMAO I Product*.
Exhibit X: Invalidity Chart: *U.S. Pat. No. 9,903,581* vs. *TSHB Product + HMAO I Product*.
Exhibit Y: Invalidity Chart: *U.S. Pat. No. 9,903,581* vs. *Lumark Product*.
Exhibit Z: Invalidity Chart: *U.S. Pat. No. 9,903,581* vs. *Lumark Product + HAMO I Product*.
Eye Lighting International: LED Lighting Distribution Types Quick Reference Guide, 2 pages.
FL800 Floodlight System, 2013, Next Generation LED Technology with AeroFlow® Cooling System, 3 pages.
FL800 Floodlight System, 2014, 4 pages.
FL800 TAG Farnborough Airport—FL800 LED Floodlights, Dec. 5, 2013.
FL800R LED Floodlight System with AeroFlow® Cooling, Nov. 2015, 7 pages.
Global TechLED Simply Universal "The World Leader in LED Retrofits" GTSOL5498 [75w-135w LED Module], 1 page (specification).
Global TechLED Simply Universal: "Solstice LED Modules," 20 pages.
Global TechLED: GTSOL5498-SOLY Global Tech Yoke Bracket LED Lights.
Global TechLED: "The Leading Force in LED Lighting Retrofit Solutions, Solstice LED Module," Application Guide, 26 pages.
Global TechLED: Retrofitting, Jan. 20, 2014, 10 pages.
H2 Pro, The Professional's Guide: Dimmable, fire-rated, IP65 LED downlight, 8 pages.
Holophane: Phuzion™ LED Performance Through Technology, 2013, 8 pages.
Holophane®: HMAO™ LED II High Mast Lighting Roadway and Area Lighting Luminaire, 2 pages.
Holophane®: HMAO™ LED II High Mast Series Brochure, 12 pages.
HScapes™: High Mast Lighting Brochure, 10 pages.
Hubbell Industrial Lighting, "KEMLUXIII Series Hazardous Location Retrofit," 2014, 4 pages.
IES-Illuminating Engineering Society: ANSI/IES RP-8-14 "Roadway Lighting," 58 pages.
Koplow, "Sandia's Radial Flow Air Bearing Heat Exchanger," Apr. 2014, 17 pages.
Lampshining: E40 Aluminum Fin Heat Sink LED Street Lights 28W, Apr. 25, 2014, 3 pages, http://ledlampshining.blogspot.com/2014/04/e40-aluminum-fin-heat-sink.
LEDs Magazine, Jul.-Aug. 2013, 64 pages.
LEDs Magazine: "Holophane adds LED technology to industry-leading portfolio of high-mast lighting solutions," Aug. 1, 2012, 3 pages.
LEDs Magazine: "Innovative LED Projector from Sill," May 6, 2010, 3 pages.
LEDs Magazine: "Sill Aeriel Modular LED Projector with Rotating Modules," May 4, 2012, 2 pages.
Liu Yi-bing: "On Thermal Structure Optimization of a Power LED Lighting," Procedia Engineering 29 (2012) 2765-2769, 5 pages.
Lumark Quadcast LED Parking Garage/Canopy Luminaire, 1 page.
Lumark® Energy Solutions: QD Quadcast, Dec. 9, 2013, 2 pages.
Lumark® Energy Solutions: Quadcast LED "Parking Garage and Canopy Luminaire Applications and Return-on-Investment Guide," 8 pages.
Lumark® Energy Solutions: Quadcast LED "Parking Garage and Canopy Luminaire," 2012, 8 pages.
Magtech Industries Corp.: "LED Driver," Product Specifications ANZ#: Z097G, Aug. 23, 2011, 2 pages.
Pal, "Modeling and Thermal Analysis of Heat Sink with Scales on Fins Cooled by Natural Convection," : IJRET: International Journal of Research in Engineering and Technology, vol. 3, Issue 6, Jun. 2014, 4 pages.
TraStar, Inc.: Duralight, LED Luminaire|LED Traffic Signal | Lamps | LED Arrow Lamps Series | TraStar, Inc., Dec. 8, 2013, 1 page.
TraStar, Inc.: High Bay LED Photo Album, 12 pages.
TraStar, Inc.: Wellington Invitation to Bid, Bid Acknowledgement, submitted Feb. 10, 2014, 31 pages.
TxDOT High Mast Illumination Details, 9 pages.
TxDOT HMLED2™ LED High Mast Lighting, 3 pages.
U.S. Department of Energy, 1 page.

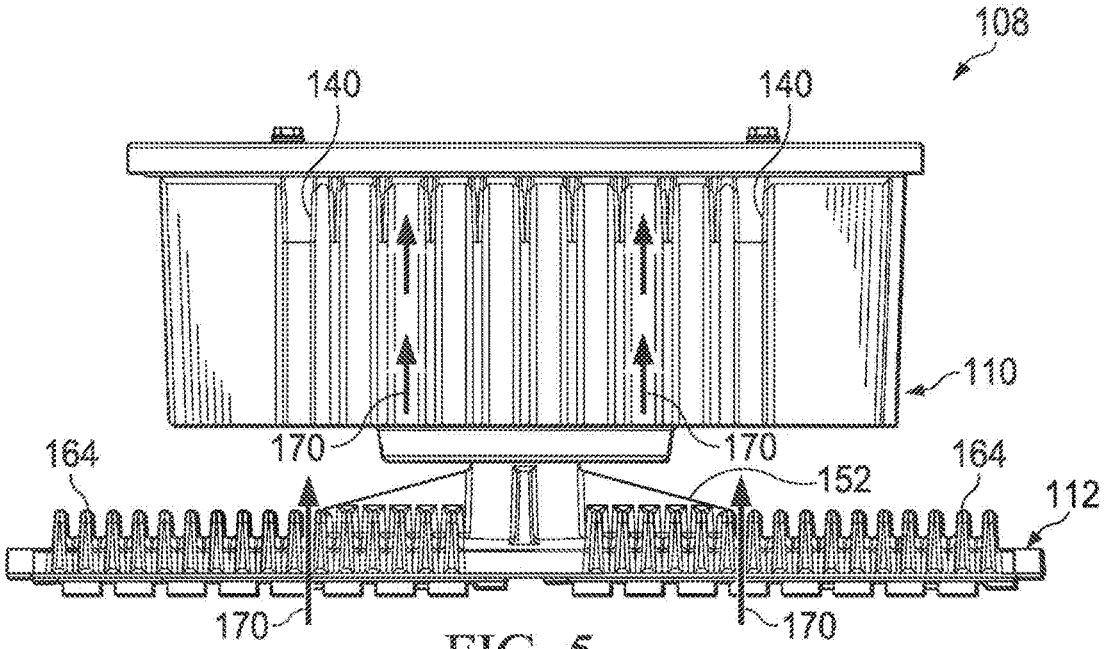
FIG. 5
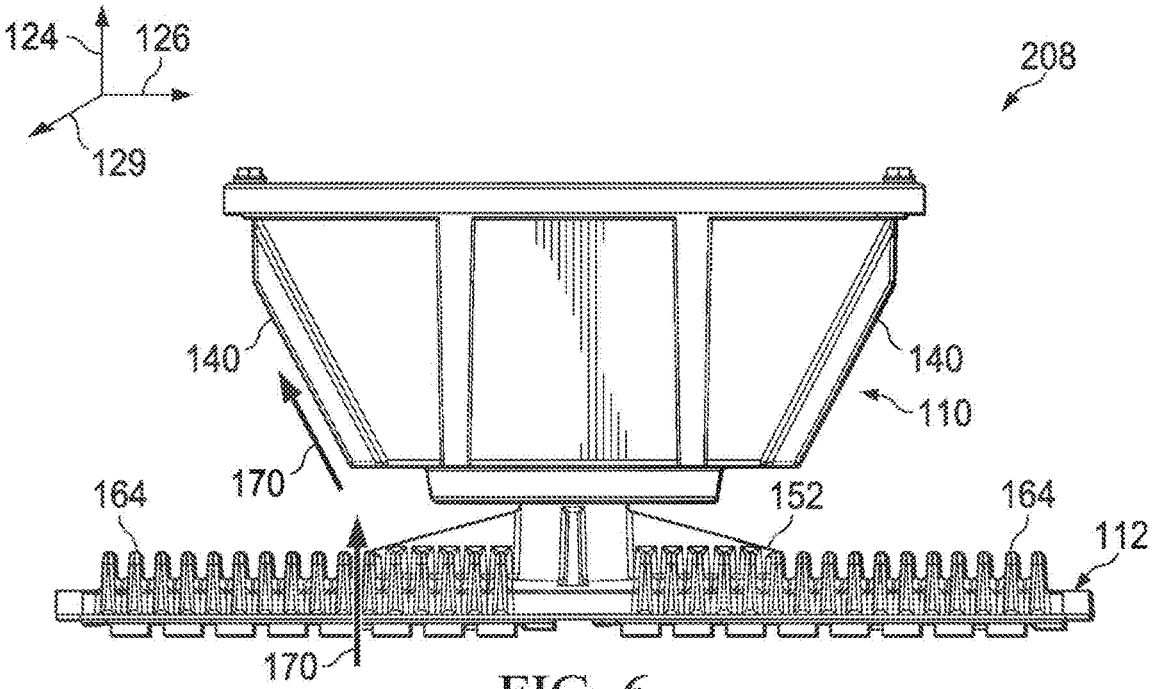
FIG. 6
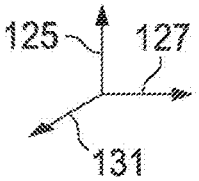

ROTATING LIGHT EMITTING DIODE HIGH MAST LUMINAIRE

CROSS REFERENCE TO RELATED APPLICATIONS

This application is a continuation application of U.S. patent application Ser. No. 15/884,597, filed on Jan. 31, 2018, now pending, which is a continuation of U.S. patent application Ser. No. 15/594,163, filed on May 12, 2017, now U.S. Pat. No. 9,903,581, which is a continuation of U.S. patent application Ser. No. 14/535,924, filed on Nov. 7, 2014, now U.S. Pat. No. 9,677,754, the disclosures of which are hereby incorporated by reference.

TECHNICAL FIELD

This disclosure relates to lighting apparatuses, and more particularly to light emitting diode (LED) lighting apparatuses for high mast applications, and even more particularly to LED lighting apparatuses with a driver mount for increased heat dissipation and surface area lighting.

BACKGROUND OF THE DISCLOSURE

The life span of an LED lighting apparatus is generally not the LED component itself but, instead, is the driver or the power source providing power to the LED component. One of the factors that limit the life span of a driver is overheating. The LED components and the driver each by itself creates a large amount of heat. Together, however, the heat can become so great that the heat starts to impact the ability of elements inside a driver housing, such as the driver, to function properly, which eventually leads to failure of the driver or the power source.

High mast applications that use LED lighting may have several sets of LED panels each set powered or driven by its own driver. A non-limiting example of LED lighting used in high mast applications is the lighting of roadways at night. Maintaining suitable temperatures to preserve the life span of the drivers and other heat sensitive elements used in these lighting apparatuses becomes difficult as the number of LED sets and respective drivers are needed. Designing LED lighting apparatuses for high mast uses present challenges given the operating environment such as the extreme height above the ground or their operation in remote locations. Extending the life of the driver by reducing the driver's heat exposure is desirable.

SUMMARY

A power source includes a housing formed of a front face and a plurality of side walls extending from the front face; the front face and the plurality of side walls define a compartment. A first ballast is secured to a first side wall of the plurality of side walls, and a second ballast is secured to a second side wall of the plurality of side walls that is disposed opposite the first side wall. A first set of passive cooling fins extends from the first side wall, and a second set of passive cooling fins extends from the second side wall.

In a first aspect, there is provided a power source housing for use with a high mast lighting apparatus, the housing having a front face and an opposing, back face. The front face closest to a back face of a light emitting diode (LED) housing. The housing further includes at least two opposing side faces extending from the front face to the back face and power housing cooling fins extending outward from the at least two opposing side faces.

In certain embodiments, the front face length is less than a back face length.

In another embodiment, the two opposing side faces create an acute angle relative to the back face of the LED housing and the front face of the power housing.

In yet another embodiment, the plurality of cooling fins extending from the at least two opposing side faces are passive cooling fins.

In some embodiments, the housing further comprises a plurality of cooling fins extending from the back face of the LED housing, wherein the two opposing side faces create an acute angle relative to the back face of the LED housing and the front face of the power housing, causing air heated from the LED housing to dissipate from the plurality of cooling fins extending from the back face of the LED housing upward toward the power housing and the power housing cooling fins thereby increasing heat transfer away from the LED housing and the power source housing.

In certain embodiments, the housing further comprises a cord aperture for allowing passage of a cord therethrough, and a cord grip for wrapping around a cord to prevent air from passing into an internal space formed by the power housing, thereby preventing the internal space from increasing in temperature due to air heated by the LED housing entering the internal space of the power housing via the cord aperture.

In a second aspect, there is provided a light emitting diode (LED) high mast lighting apparatus having a LED housing having a panel configured for receiving a plurality of LEDs. The apparatus further includes a power housing separate from and coupled to the LED housing with a gap between the LED housing and the power housing.

In certain embodiments, the lighting apparatus further comprises an extension member connected at one end to the power housing and at another end to the LED housing to create the gap between the housings.

In another embodiment, the lighting apparatus further comprises at least one LED driver contained in the internal space formed by the power housing; LED housing cooling fins positioned on the LED housing and facing the power housing; and power housing cooling fins positioned on the power housing. The LED housing cooling fins and the power housing cooling fins form an acute angle and the extension member between the LED housing and the power housing reduces heat transfer between the LED housing and the internal space formed by the power housing via convection and conduction.

In yet another embodiment, the lighting apparatus further comprises two or more LED drivers, each LED driver positioned at opposite sides of the power housing to maximize heat dissipation inside the power housing.

In some embodiments, the LED housing swivels relative to the power housing.

In a third aspect, there is provided a lighting apparatus for use with a light emitting diode (LED) panel, having an LED panel configured to receive a plurality of LED lights, a power source, and an extension member. The extension member is connected to the LED panel at a first end and to the power source at a second, opposing end. The extension member is rotatable, thereby allowing the LED panel to rotate up to 360 degrees about an axis.

In certain embodiments, the lighting apparatus further includes a mast, wherein the LED panel and the power source are connected to the mast.

In another embodiment, the lighting apparatus further comprises a plurality of cooling fins extending from the LED panel.

In yet another embodiment, the lighting apparatus further comprises a plurality of cooling fins extending from a power housing containing the power source.

In some embodiments, the lighting apparatus further comprises a plurality of cooling fins extending from the LED panel and a plurality of cooling fins extending from a power housing containing the power source.

In a fourth aspect, there is provided a light emitting diode (LED) high mast lighting apparatus, having a LED housing, a power source for providing power to the LED housing, and an extension member extending between the LED housing and the power source. The extension member is configured to reduce thermal conduction between the LED housing and the power source.

In certain aspects, the extension member further comprises a first end attached to a back side of the LED housing and an opposing, second end attached to the front side of the power housing.

In one embodiment, the lighting apparatus further comprises a cord extending at least the length of the extension member configured to provide power from the power source to the LED lights.

In another embodiment, the length of the extension member is in a range of between about one inches and four inches.

In yet another embodiment, the lighting apparatus further comprises a power housing containing the power source. The power housing includes a front face and an opposing, back face, the front face closest to a back face of the LED housing, wherein the LED housing has a front face and the opposing, back face. The power housing further including at least two opposing side faces extending from the front face to the back face of the power housing and cooling fins extending outward from the at least two opposing side faces of the power housing. The front face of the power housing has a length less than a length of the back face of the power housing.

Other aspects, features, and advantages will become apparent from the following detailed description when taken in conjunction with the accompanying drawings, which are a part of this disclosure and which illustrate, by way of example, principles of the inventions disclosed.

BRIEF DESCRIPTION OF THE DRAWINGS

The accompanying drawings facilitate an understanding of the various embodiments.

FIG. 5 is a side view of one embodiment of an LED lighting apparatus illustrating a thermal flow path.

FIG. 6 is a side view of an embodiment of an LED lighting apparatus illustrating a thermal flow path.

DETAILED DESCRIPTION

Figure 1:
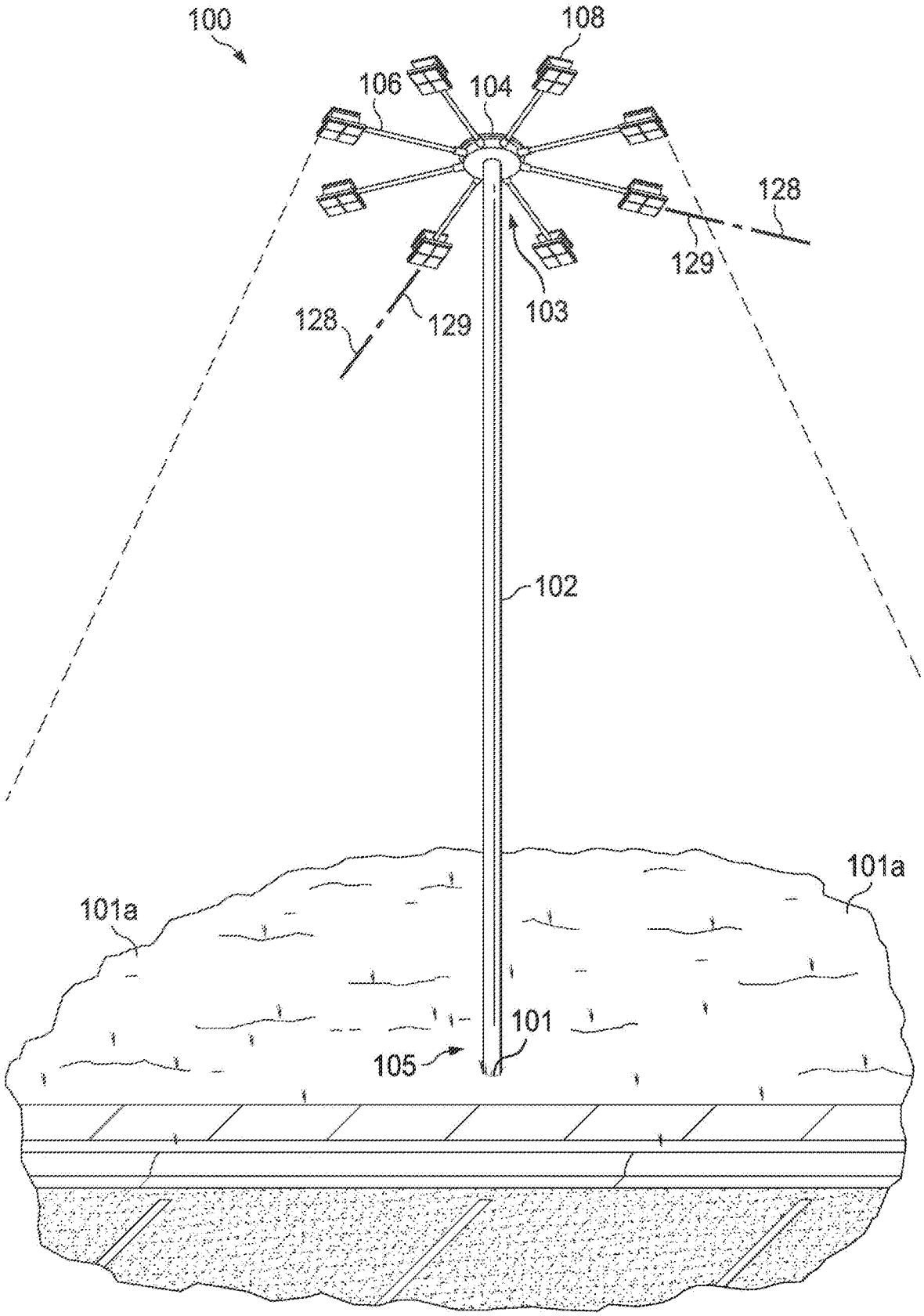
FIG. 1 is a perspective view of a high mast lighting system.

Referring to FIG. 1, an exemplary embodiment of a high mast lighting system 100 is presented. The high mast lighting system 100 illustrated includes a mast 102, a hub 104 positioned on a top portion 103 of the mast 102, a plurality of extension members 106 attached to the hub 104, and a plurality of light emitting diode (LED) lighting apparatuses 108 attached to the extension members 106. The high mast lighting system 100 may be used to light roadways, overpasses or highways, and in one embodiment, the high mast lighting system 100 may be adapted for use in sports lighting, arena lighting, security lighting, and track lighting. The high mast lighting system 100 illustrated is a non-limiting embodiment of a high mast lighting system configured and operable to provide uniform light distribution with less glare and less weight than traditional high-intensity discharge (HID) lighting components with a longer service life than comparable LED lighting apparatuses. Uniform light distribution with less glare increases safety, components with a lighter weight generally reduce production costs, and a longer service life reduces service costs especially given that these high mast lighting systems 100 are difficult to service due to the LED lighting apparatuses' 108 height above the ground, and in some instances, the system's 100 deserted locations.

The mast 102 includes the top portion 103 and a bottom portion 105. The bottom portion 105 is securely attached to a ground area or base 101, and the top portion 103 is securely attached to the hub 104. Extending outward from the hub 104 is the plurality of extension members 106, which may also be referred to as tenons. The plurality of extension members 106 are cantilevered from the hub 104. In some aspects, the extension members 106 are attached directly to the mast 102 and cantilevered therefrom. It should be appreciated by one of ordinary skill in the art that only one of the extension member 106 and corresponding LED lighting apparatus 108 may be deployed. Likewise, in some aspects the mast 102, the hub 104, or a combination thereof may not be necessary as other structures may be used as an attachment mechanism for the plurality of extension members 106 and corresponding LED lighting apparatuses 108, or simply the LED lighting apparatuses 108 by itself.

Generally, the positioning of the extension members 106 depends on the terrain or topographical layout of an area 101*a* to be illuminated so that the area 101*a* to be illuminated has uniform light distribution and reduced glare. Therefore, the positioning of the extension members 106 may be different depending on the layout of roadways or when the plurality of extension members 106 are used to illuminate intersections, overpasses, or other roadway configurations. Moreover, the positioning of the plurality of extension members 106 may also be different when used with the plurality of LED lighting apparatuses 108 when used in stadium lighting. The terrain or topographical layout of the area 101*a* to be illuminated, typically determines the positioning of the extension members 106 and the corresponding LED lighting apparatuses 108 so that the LED lighting apparatuses 108 can provide uniform light distribution with reduced glare. The system 100 described herein provides this flexibility in configuration.

Each extension member 106 extends along a longitudinal axis 128. In one aspect, the plurality of extension members 106 extends along the respective longitudinal axis 128 radially from the hub 104. In some aspects, the plurality of extension members 106 forms a polar array such that each of the plurality of extension members 106 lies within the same plane. In this aspect, the plurality of extension members 106 may be substantially horizontal to the ground area 101 or the area 101*a* to be illuminated. In another aspect, the plurality of extension members 106 may extend radially from the hub 104 at various angles. In this aspect, one extension member 106 may be positioned higher relative to another extension member 106. This configuration may be deployed when the topographical layout of the area 101*a* to be illuminated varies; e.g., an overpass.

The extension members 106 may be equal distance from each other as shown in FIG. 1 or, alternatively, some of the extension members 106 may be positioned in clusters such that not all the extension members 106 are equal distance from each other. In one non-limiting embodiment, this configuration may be used when the high mast lighting system 100 is positioned between two separate roadways and the high mast lighting system 100 is used to illuminate both roadways. In this aspect, the extension members 106 may be positioned in a first cluster over one of the roadways and a second cluster over the other roadway. Again, the positioning of the extension members 106 depends on the terrain or topographical layout of the area 101*a* to be illuminated.

Figure 2:
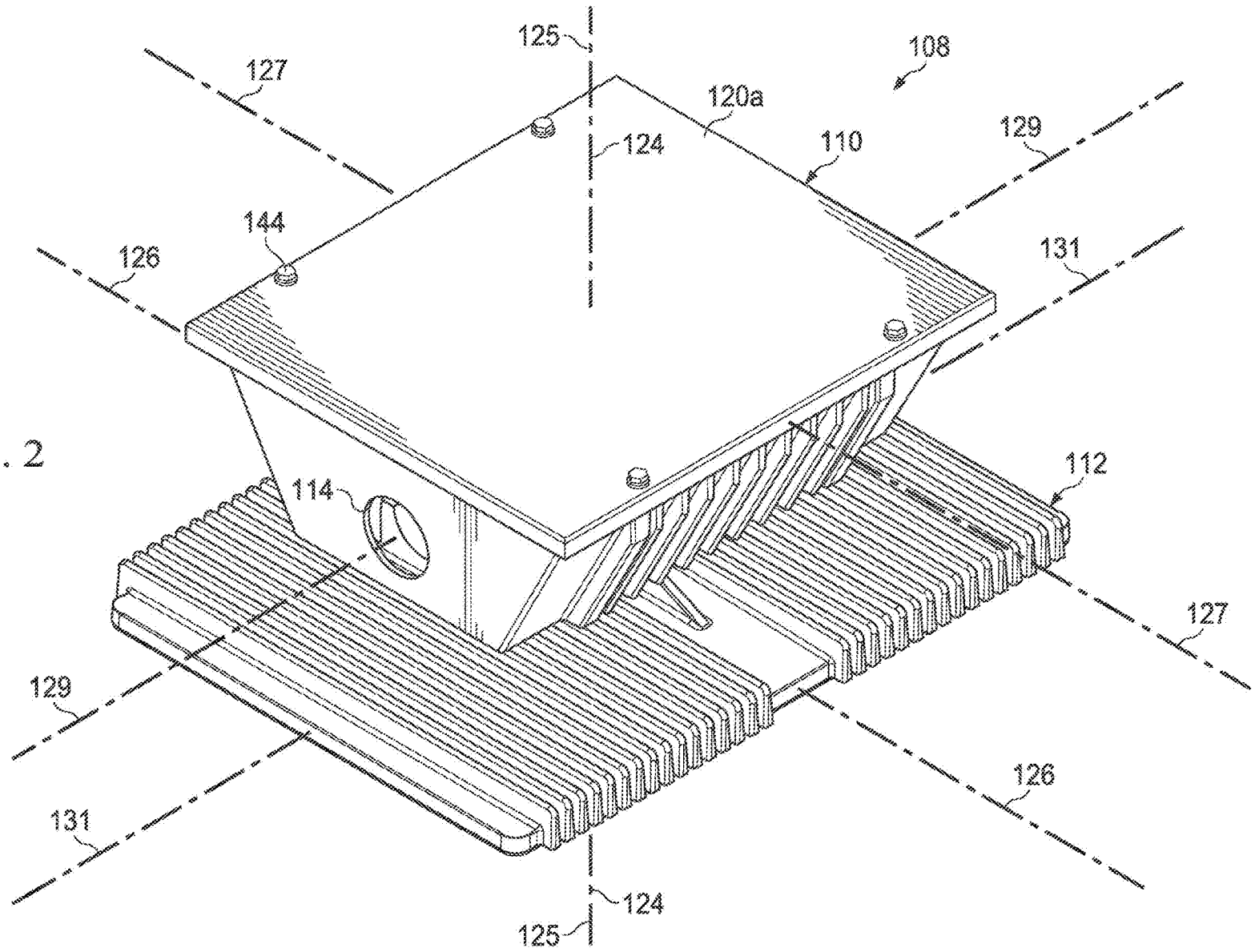
FIG. 2 is a top, perspective view of a LED lighting apparatus for use in a high mast light application, such as the high mast lighting system illustrated in FIG. 1.
Figure 3:
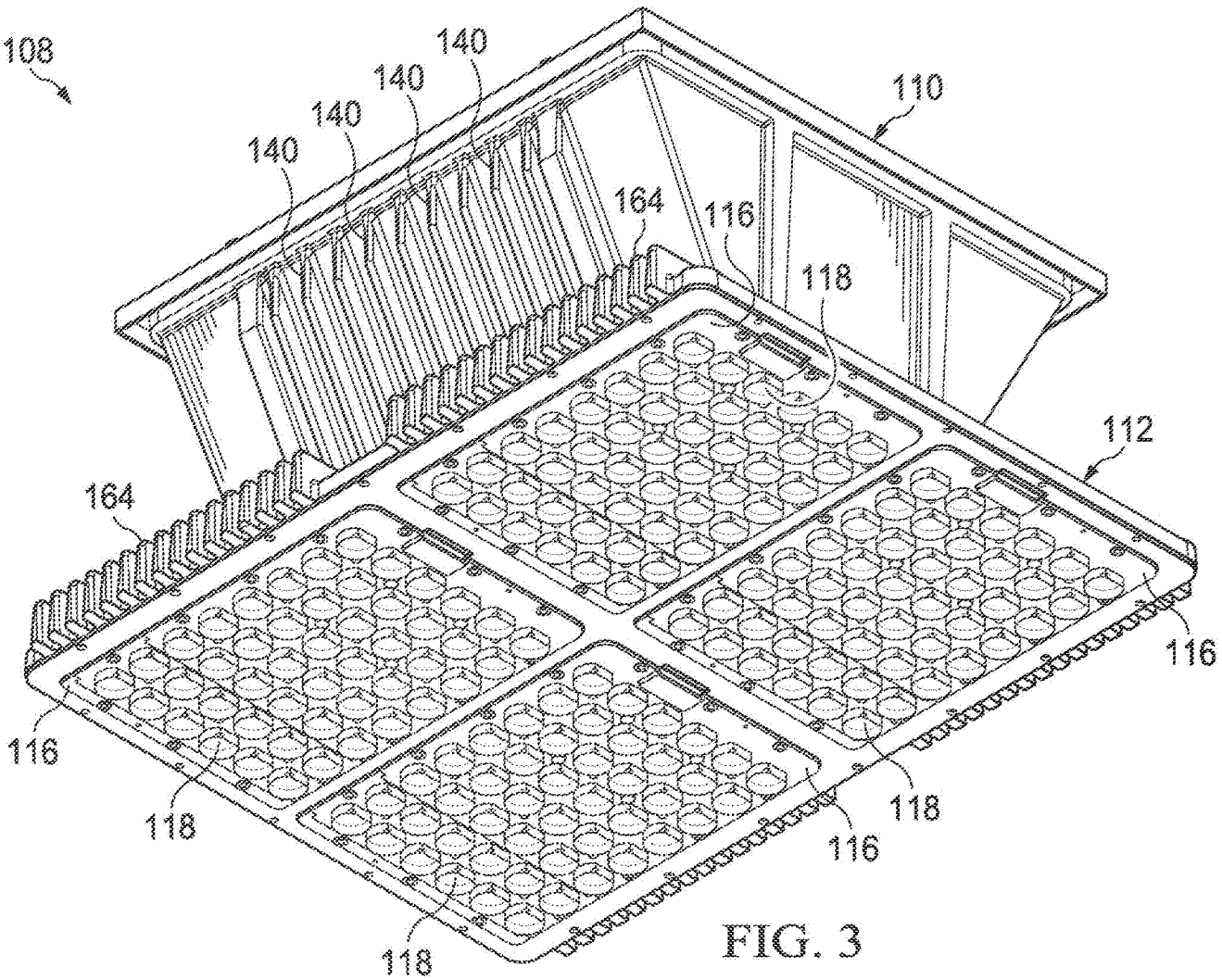
FIG. 3 is a bottom, perspective view of the LED lighting apparatus of FIG. 1.

Referring to FIGS. 1-2, attached to each extension member 106 is the corresponding LED lighting apparatus 108. Each of the LED lighting apparatuses 108 includes a driver or power housing 110 and a LED housing 112. In an exemplary, non-limiting embodiment, the power housing 110 has a longitudinal axis 129 and the LED housing 112 has a longitudinal axis 131. In some aspects, the longitudinal axis 129 of the power housing 110 is parallel with the longitudinal axis 131 of the LED housing 112, and the longitudinal axis 129 of the power housing 110 is co-axial with the longitudinal axis 128 of the extension member 106. An aperture 114 is formed in the power housing 110 for receiving one end of the extension member 106. In some aspects, the LED lighting apparatus 108 is angled relative to the extension member 106 such that the longitudinal axis 129 of the LED lighting apparatus 108 is angled relative to the longitudinal axis 128 of the extension member 106. In these aspects, the aperture 114 may still receive the extension member 106. Connecting components (not shown) that attach the extension member 106 to the LED lighting apparatus 108 may be operable to allow the LED lighting apparatus 108 to be positioned in an angled orientation relative to the extension member 106. It should be appreciated that the extension members 106 and corresponding LED lighting apparatuses 108 may extend from the hub 104 or the portion 103 of the mast 102 in any number of configurations.

As previously mentioned, the LED lighting apparatus 108 includes the driver or power housing 110 and the LED housing 112. In one embodiment, the power housing 110 includes a transverse axis 127 that is perpendicular to the longitudinal axis 129 of the power housing 110. Likewise, the LED housing 112 has a transverse axis 126 that is perpendicular to the longitudinal axis 131 of the LED housing 112. The transverse axis 127 of the power housing 110 is parallel to the transverse axis 126 of the LED housing 112. In this embodiment, the power housing 110 further includes a centerline axis 124, and the LED housing 112 further includes a centerline axis 125. The centerline axis 124 of the power housing 110 is generally co-linear with the centerline axis 125 of the LED housing 112. The centerline axes 124, 125 are generally perpendicular to the transverse axes 126, 127 and the longitudinal axes 129, 131. Both of the housings 110, 112 are illustrated and described as having a polygonal construction; however, the housings 110, 112 are not limited to polygonal construction and could, for example, have rounded aspects to the construction or take the form of a number of other shapes.

Referring now to FIGS. 2-5, the LED lighting apparatus 108 will be described in more detail. The LED lighting apparatus 108 includes the driver or power housing 110 and the LED housing 112. The power housing 110 is separate and thermally isolated from but connected to the LED housing 112. The power housing 110 is connected to the LED housing 112 in a base-up position, meaning that the power housing 110 is positioned above the LED housing 112. The LED housing 112 is operable to swivel relative to the power housing 110. In an aspect, the LED housing 112 is operable to rotate up to 360 degrees about its central axis 125.

In one embodiment, the LED housing 112 is movable so that it can be angled relative to the driver housing 110 and, therefore, align with a horizontal plane, the horizontal plane generally representing the area 101*a* to be illuminated. Contemporary LED High Mast lighting configurations do not allow the light source to be angled, rotated, or swivel relative to the driver housing. In the LED applications where an LED array is rotatable, the LED and heat sink are rotated within an enclosure. The enclosure traps heat, shortening LED lifespan and reducing LED efficiency. It is advantageous, however, for the light source or LED panel to be able to swivel, rotate, or be angled when used to illuminate the area 101*a* so as to provide better illumination and reduced glare.

In some aspects, a number of connectors (not shown) may be implemented for allowing various positioning of the LED lighting apparatus 108. There may be connectors located at the hub 104, between the hub 104 and the extension member 106, between the extension member 106 and the lighting assembly 108, between the power housing 110 and the LED housing 112, or a combination thereof.

An extension member 148 attaches the power housing 110 to the LED housing 112. The extension member 148, in one non-limiting embodiment, is an integral part of the LED housing 112. In this embodiment, the extension member 148 may rotate with the LED housing 112. In some aspects, however, the extension member 148 includes a first end 150 connected to the LED housing 112 and an opposing second end 152 connected to the driver housing 110. The extension member 148 extends between the driver housing 110 and the LED housing 112, creating a junction 133 therebetween. The junction 133 forms a gap 132 that puts distance between the driver housing 110 and the LED housing 112. In one aspect, the extension member 148 or the gap 132 functions to provide thermal isolation between the power housing 110 and the LED housing 112. The extension member 148 reduces heat transfer between the LED housing 112 and the power housing 110 via convection and conduction by providing separation between the two housings 112, 110 via the gap 132. In operation, the extension member 148 and the gap 132 help control the operating temperatures of both the LEDs 118 and the drivers 130 to temperatures that allow maximum efficiency. In a non-limiting, illustrative embodiment, the extension member 148 has a length in a range of about one inch to four inches. In some aspects, the gap 132 creates a distance between the power housing 110 and the LED housing 112 in a range of about one inch to four inches. The disclosed length of the extension member 148 and the distance created by the gap between the power housing 110 and the LED housing 112 is for illustrative purposes only and one having skill in the art will appreciate other lengths or distances may be utilized; for example, the length or the distance may be 0.25 inches, 0.5 inches, 1 inch, 2 inches, 3 inches, 4 inches, 5 inches, or more.

Still referring to FIGS. 2-5, the driver or power housing 110 houses the components that are used to power the LED components associated with the LED housing 112. The power housing 110 includes a front face 122 and an opposing back face 120. The back face 120 of the driver housing 110 may have a cover 120*a*. One or more attachment members 144 may be used to secure the cover 120*a* to the back face 120. In one non-limiting embodiment, the one or more attachment members 144 may be bolts. At least two opposing side faces, comprising a first side wall 136 and an opposing second side wall 138 extend between the front face 122 and the back face 120. Power housing cooling fins 140 extend outward from the first side wall 136 and the second side wall 138. The power housing cooling fins 140, in some aspects, extend outward from other portions of the power housing 110. The power housing cooling fins 140 are not limited to extending outward from only the first side wall 136, the second side wall 138, or combination thereof. The power housing cooling fins 140 are passive cooling fins that act as a heat sink for heat generated by components in the power housing 110. As will be discussed in more detail below, the power housing cooling fins 140 further aid in dissipating heat that is generated from the LED housing 112, radiating toward or rising into the power housing 110.

In one embodiment, the front face 122 of the power housing 110 has a length, L2, that is less than a length, L1, of the back face 120 of the power housing 110. In certain aspects the two opposing side faces, i.e., the first side wall 136 and the second side wall 138 form an acute angle 142 relative to the front face 122 of the power housing 110. The power housing 110 forms an internal space or compartment 146 that houses a power source 154. The power source 154 includes at least one or more drivers 130, which may also be referred to as ballasts. The power source 154 may further include a surge protector 134 and a terminal block assembly 135. Further included in the internal space 146 of the driver housing 110 is a cord aperture 156 for receiving a cord 157 (only partially shown) from the LED housing 112 and a cord grip 158 for gripping the cord to thermally isolate the portion of the cord 157 connected to the driver housing 110 from the portion of the cord 157 associated with the LED housing 112. The cord grip 158 thermally isolates the cord by preventing heated air from traveling through the cord aperture 156 along the outer surface of the cord 157. In other words, the cord grip 158 prevents the temperature in the internal space 146 from increasing via convection from air heated by the LED housing 112.

In certain aspects, the drivers 130 are positioned on the first and second sidewalls 136, 138. When more than one driver 130 is utilized, the drivers 130 may be mounted on different side walls. In one aspect, the drivers 130 are mounted in the driver housing 110 on the first and second sidewalls 136, 138 with the passive cooling fins 140 extending from the other side of the respective side wall. The drivers 130 are separated from each other on opposing walls of the housing 110 to lower the thermal heat density by minimize the heating of one driver 130 by heat generated by another driver 130, i.e., keeping the heat generated by one driver 130 from increasing the temperature of another driver 130. The power housing cooling fins 140 may be cast as part of the power housing 110. In one aspect, power housing cooling fins 140 provide heat dissipation for the power housing 110 by acting as a heat sink for heated air trapped in the internal space or compartment 146. In another aspect, the drivers 130 share the same wall with the power housing cooling fins 140, the drivers 130 being positioned opposite the power housing cooling fins 140, so that heat generated by the drivers 130 has a direct conduction path to the power housing cooling fins 140 and, thus, the external environment, which promotes conductive heat transfer out of the power housing 110. This arrangement helps prevent heat generated by the drivers 130 from collecting in the internal space 146 via convection. The air in the internal space or compartment 146 is heated because the drivers 130 and other power supply components contained within the power housing 110 generate heat. Thus, in some aspects, the drivers 130 share the same side wall as the power housing cooling fins 140.

The sidewalls 136, 138 are typically angled relative to the LED housing 112 to help dissipate heat via convection from the cooling fins 140. Likewise, the cooling fins 140 extending from the driver housing 110 are angled relative to the LED housing 112 in a manner that helps dissipate heat radiated into the power housing 110 from the LED housing 112 by providing a thermal pathway 170 for heat dissipation (see FIG. 5). In operation, air heated by the LED housing 112 radiates toward the power housing 110 because the power housing 110 is positioned above the LED housing 112. The angled or inclined orientation of the sidewalls 136, 138, the cooling fins 140, or combination thereof, prevents heated air from being trapped between the two housings 110, 112 by providing the thermal pathway 170. In one aspect, not shown, the at least two opposing side faces 136, 138 may be vertical, i.e., not angled relative to the LED housing 112, with the cooling fins 140 extending from the at least two opposing side face 138, 138, the cooling fins 140 being angled themselves. It should be appreciated, however, that angling the sidewalls 136, 138 is beneficial as it allows the drivers 130 to also be angled, ensuring that 100% of the driver cooling fins 140 is exposed to the upward airflow from the LED housing 112—while the upward airflow from the LED housing 112 is warm air, the upward airflow increases the thermal transfer rate of heat away from the drivers 130 because air wants to uniformly flow through the driver cooling fins 140.

The LED housing 112 has a front face 160 and an opposing back face 162. When assembled, the back face 162 of the LED housing 112 is closest to the front face 122 of the power housing 110. In some aspects, the sidewalls 136, 138 form an acute angle such as acute angle 142 relative to the back face 162 of the LED housing 112. A plurality of LED housing cooling fins 164 extend from the back face 162 of the LED housing 112 and function as a heat sink for heat generated by the LED housing 112. The plurality of LED housing cooling fins 164 are directed toward the power housing 110.

The LED housing 112 further includes a number of LEDs panels 116 on the front face 160 with each LED panel 116 comprising one or more LEDs 118. The LED panels 116 are powered by components in the driver housing 110. Generally, for each LED panel 116 there is a corresponding driver 130 contained in the driver housing 110. The LED housing 112 and the LED panels 116 are configured to provide uniform light distribution with less glare and less weight than traditional high-intensity discharge (HID) lighting components. The LED panels 116 may be arranged in any shape or size. Lights can be eliminated selectively to form a particular shape or can be utilized to compensate for lights that are not functioning.

Heat from the LED housing 112 is generated when electrical current is not converted into light emitted from the LEDs 118. In some aspects, about 75% of energy run-through the LED is converted to heat. The generated heat causes the temperature around the LEDs 118 and the LED housing 112 to increase. Increased temperatures may contribute to reduced lumen output from the LEDs 118 and shorten the LEDs 118 service life. Likewise, if the heat generated by the LED housing 112 is not dissipated away from the power housing 110, the heat generated by the LED housing 112 may affect the service life of the drivers 130 contained in the power housing 110. It is therefore beneficial to dissipate generated heat from the LED lighting apparatus 108.

Figure 4A:
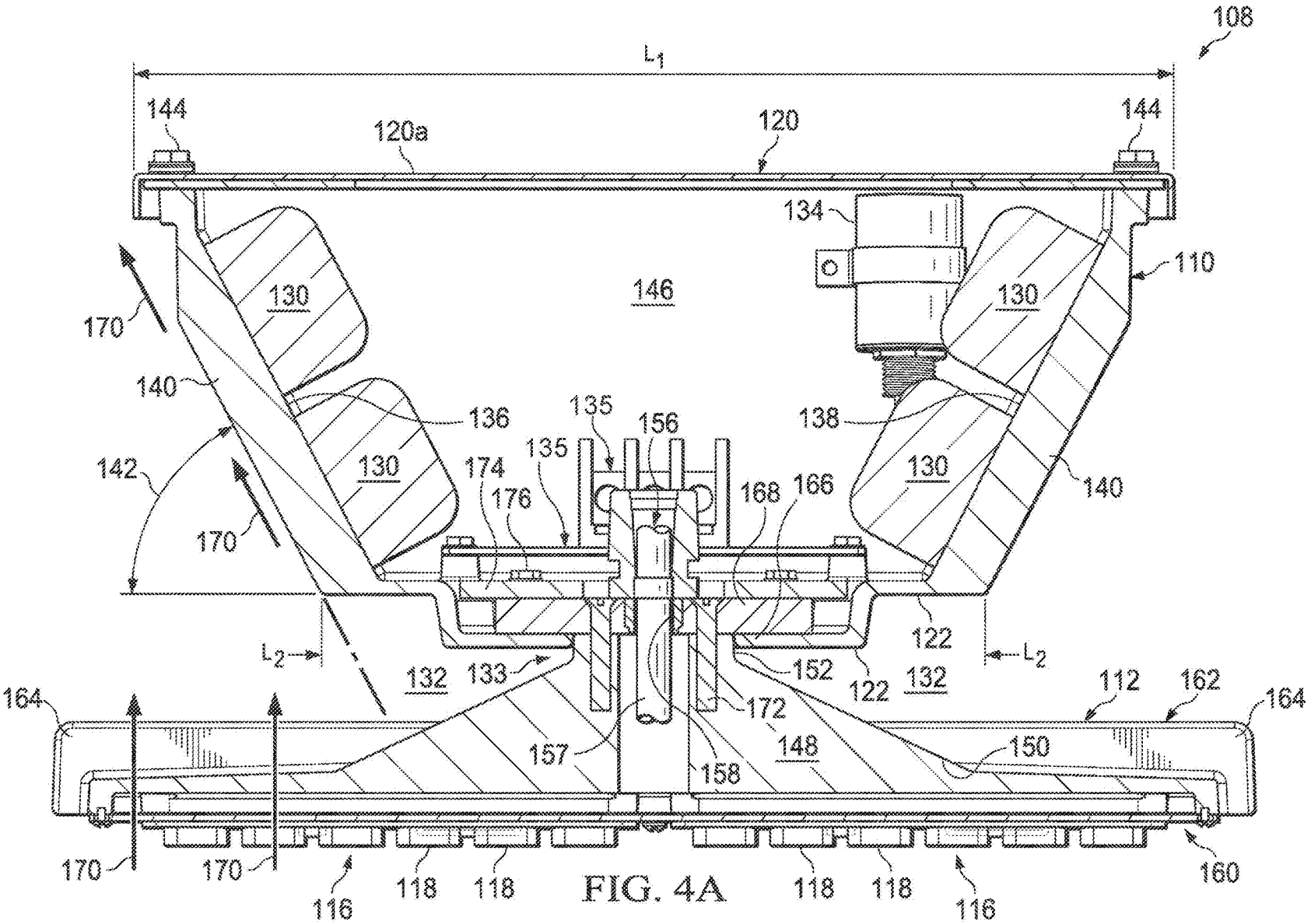
FIG. 4A is a cross-sectional view of an LED lighting apparatus according to one embodiment.
Figure 4B:
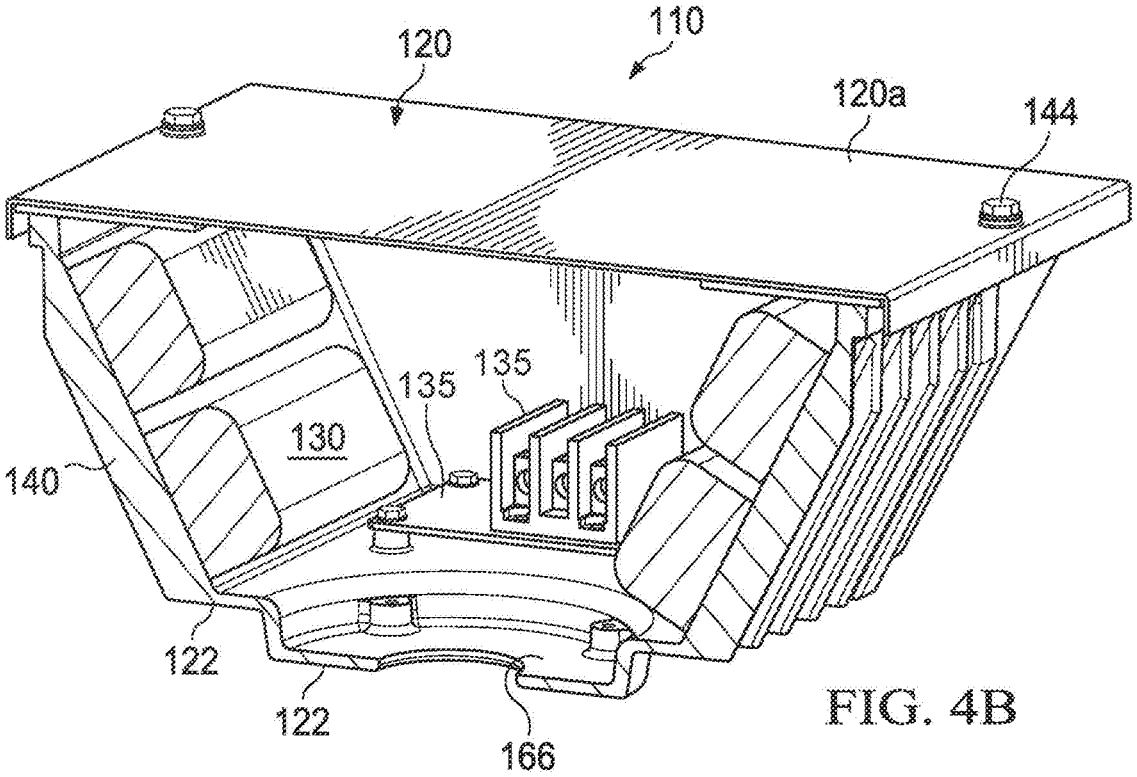
FIG. 4B is a cross-sectional, perspective view of a power housing according to the LED lighting apparatus of FIG. 4A.
Figure 4C:
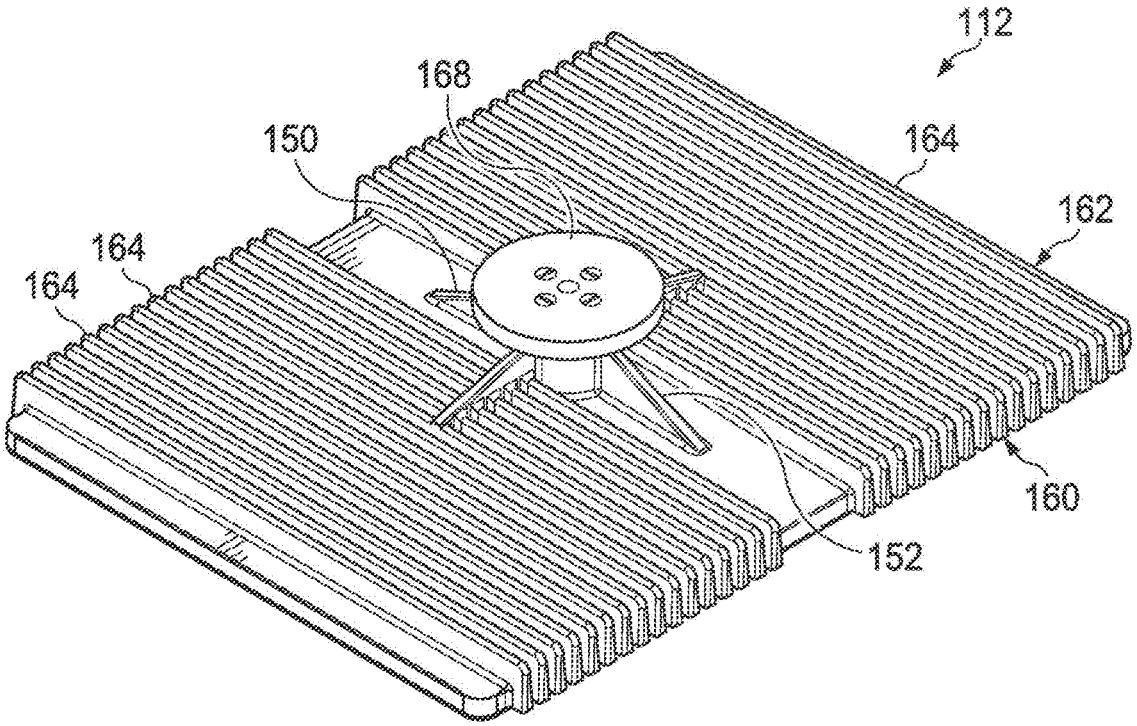
FIG. 4C is a perspective view of a LED housing according to the LED lighting apparatus of FIG. 4A

Referring now primarily to FIGS. 4A-4C, but with continued reference to FIGS. 2-5, an illustrative embodiment for connecting the power housing 110 to the LED housing 112 is presented. The front face 122 of the power housing 110 includes a shoulder 166 for supporting a support member 168. In one embodiment, an outer portion of the support member 168 is supported by the power housing 110 via the shoulder 166. The support member 168 may be a plate, formed in a number of shapes to include round, square, or rectangular shapes. The support member 168 is connected to the extension member 148. In one embodiment the support member 168 is attached to the second end 152 of the extension member 148. The support member 168 may be connected to the extension member 148 using attachment members 172 such as countersunk screws. Once the support member 168 is connected to the extension member 148 a technician may rotate or swivel the LED housing 112 relative to the power housing 110 so as to position the LED housing 112 into the best position for illuminating the area 101*a*. A locking member 174 may clamp the support member 168 against the shoulder 166 to prevent further movement of the LED housing 112 relative to the power housing 110. The locking member 174 may be a plate that is positioned adjacent the support member 168. Attachment members 176 secure the locking member 174 to the support member 168. The attachment members 176, for example, may be bolts. Using the power housing 110 via the shoulder 166 to support the support member 168 provides added safety so that the LED housing 112 will not fall should a technician not adequately lock the support member 168 in place using the locking member 174.

Referring now primarily to FIG. 5 but with continued reference to FIGS. 2-4C, the heat generated by the LEDs 118 and the LED housing 112 rises toward the power housing 110 due to the orientation of the LED lighting apparatus 108, i.e., the driver housing 110 being generally positioned above the LED housing 112. In practice, an LED high mast luminaire must be designed to fit within the same form factor of a traditional HID high mast luminaire, i.e., sized to fit on existing lighting systems. This requires the driver housing 110 to be generally positioned above the LED lighting apparatus 108. The driver housing's 110 passive cooling fins 140 help prevent heated air that rises from the LED housing 112 from becoming trapped at the junction 133 or in the gap 132 between the driver housing 110 and the LED housing 112. It should be further noted that ambient temperature surrounding the LED housing 112, the power housing 110, and the gap 132 therebetween affect the overall temperature surrounding the LED housing 112, the power housing 110, the junction 133. Hot air from the LED housing 112 flows upward from the LED cooling fins 164. As the heated air rises, cooler air from the atmosphere or surrounding area fills the deficiency left by the heated air, thereby creating an airflow, i.e., the thermal pathway represented by the arrows 170. The thermal pathway 170 rolls along the driver housing cooling fins 140, acting to increase heat transfer away from the drivers 130 as the upward airflow pulls cooler, surrounding air along the driver housing cooling fins 140. It should be appreciated that mounting the drivers 130 at an angle increases the surface area that is exposed to the chimney of hot air from the LED housing 112 and therefore cooler air according to the thermal pathway 170.

The LED lighting apparatus 108 facilitates both air convection and conduction to cool the LED housing 112, the power housing 110, the components associated with the housings 110, 112, and the junction 133 between the housings 110, 112, to help ensure longer life, higher delivered lumens over time, and color consistency. The heat dissipation methods used by the LED lighting apparatus 108 are passive meaning no internal fans or alternative cooling devices are required to dissipate heat.

Referring to FIG. 6, another embodiment of a LED lighting apparatus 208 is presented. The LED lighting apparatus 208 is similar to the LED lighting apparatus 108 illustrated in FIGS. 4A-4C with one exception. The cooling fins 164 of the LED housing 112 extend along the longitudinal axis 129 of the LED housing 112 instead of the transverse axis 127 as illustrated in FIGS. 4A-4C.

In operation, the configuration of the LED lighting apparatus 108 functions to dissipate heat generated by the components associated with the two housings 110, 112 to increase the life of the LEDs 118 and preserve the quality of the LEDs' 118 light output. In one aspect, the LED panel 116 is positioned substantially horizontal to the area 101*a* to be illuminated to increase the efficiency of the light output relative to the light captured at the area 101*a* to be illuminated. This orientation further functions to decrease glare. In another aspect, the LED housing cooling fins 164 extending from the back face 162 of the LED housing 112 dissipates heat generated by the LED housing 112. In yet another aspect, the orientation of the power housing cooling fins 140 provides several benefits. First, as air is dissipated from the LED housing 112 upward toward the power housing 110 (due to the nature of hot air rising), the power housing cooling fins 140 prevent heated air from becoming trapped between the LED housing 112 and the power housing 110 by providing a low resistance pathway, as indicated by the arrows 170, for the hot air to follow; the pathway extending along the power housing cooling fins 140. Second, the power housing cooling fins 140 provide heat dissipation for the power housing 110 by acting as a heat sink for heated air trapped in the internal space or compartment 146. The power housing cooling fins 140 act as a passive heat sink allowing heat generated from the driver 130 to be conducted through the angled side face walls 136, 138 and into the power housing cooling fins 140. In certain aspects, the angled position of the power housing cooling fins 140 induces airflow along the cooling fins to both remove heat surrounding the power housing cooling fins 140 and to pull heated air away from the LED housing 112.

As described above, in the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. As stated above, terms such as "top", "bottom", "above", "below", "upward" and "downward" and the like are used as words of convenience to provide reference points and are not to be construed as limiting terms.

In this specification, any use of the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have been described in connection with what are presently considered to be the most practical and preferred embodiments, it is to be understood that the invention(s) are not to be limited to the disclosed embodiments, but on the contrary, are intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A high mast luminaire, comprising:
a power housing defining an internal space;
a power source disposed within the internal space;
a light emitting diode (LED) housing supporting a plurality of LEDs powered by the power source;
a plurality of LED cooling fins extending from a back face of the LED housing; and
an extension member extending from the power housing to the LED housing;
wherein the LED housing and the plurality of LED cooling fins are rotatable with respect to the power housing.

2. The high mast luminaire of claim 1 wherein the power housing defines an aperture configured to receive a high mast extension member to support the high mast luminaire.

3. The high mast luminaire of claim 1 wherein the extension member creates a gap between the power housing and the back face of the LED housing.

4. The high mast luminaire of claim 1 further comprising a plurality of power housing cooling fins extending from the power housing.

5. The high mast luminaire of claim 1 wherein the power source comprises at least one driver.

6. The high mast luminaire of claim 1 wherein the power source comprises a plurality of drivers.

7. The high mast luminaire of claim 1 wherein the plurality of LED cooling fins substantially covers the back face of the LED housing.

8. The high mast luminaire of claim 1 wherein the extension member defines an aperture, and further comprising a cord extending from the power housing to the LED housing through the aperture.

9. The high mast luminaire of claim 1 wherein the LED housing is rotatable approximately 360° with respect to the power housing.

10. A high mast luminaire, comprising:
a power housing defining an internal space;
a plurality of drivers disposed within the internal space;
a light emitting diode (LED) housing supporting at least one LED panel, the at least one LED panel supporting a plurality of LEDs powered by at least one of the plurality of drivers;
a plurality of LED cooling fins extending from a back face of the LED housing; and
an extension member extending between the power housing and the LED housing;
wherein the LED housing and the plurality of LED cooling fins are rotatable with respect to the power housing.

11. The high mast luminaire of claim 10 wherein the power housing defines an aperture configured to receive a high mast extension member to support the high mast luminaire.

12. The high mast luminaire of claim 10 wherein the extension member creates a gap between the power housing and the back face of the LED housing.

13. The high mast luminaire of claim 10 further comprising a plurality of power housing cooling fins extending from the power housing.

14. The high mast luminaire of claim 10 wherein the plurality of LED cooling fins substantially covers the back face of the LED housing.

15. The high mast luminaire of claim 10 wherein the LED housing is rotatable approximately 360° with respect to the power housing.

16. A high mast lighting system, comprising:
a mast;
a hub supported by the mast;
a plurality of tenons extending from the hub, each tenon supporting a luminaire, comprising:
a power housing defining an internal space;
a power source disposed within the internal space;
a light emitting diode (LED) housing supporting a plurality of LEDs powered by the power source;
a plurality of LED cooling fins extending from a back face of the LED housing; and
an extension member extending from the power housing to the LED housing;
wherein the LED housing and the plurality of LED cooling fins are rotatable with respect to the power housing.

17. The high mast lighting system of claim 16 wherein the extension member of each luminaire creates a gap between the power housing and the back face of the LED housing.

18. The high mast lighting system of claim 16 wherein each luminaire further comprises a plurality of power housing cooling fins extending from the power housing.

19. The high mast lighting system of claim 16 wherein the LED cooling fins of each luminaire substantially cover the back face of the LED housing.

20. The high mast lighting system of claim 16 wherein the LED housing of each luminaire is rotatable approximately 360° with respect to the power housing.

21. A high mast luminaire, comprising:
a power housing defining an aperture and an internal space, the aperture configured to receive a high mast extension member;
a power source disposed within the internal space;
a light emitting diode (LED) housing supporting a plurality of LEDs;
a plurality of LED cooling fins extending from a back face of the LED housing; and
an extension member extending between the back face of the LED housing and the power housing.

22. The high mast luminaire of claim 21 wherein the LED housing is an outermost housing enclosing all of the LEDs of the high mast luminaire.

23. A high mast luminaire, comprising:

a power housing defining an aperture and an internal space, the aperture configured to receive a high mast extension member;

a power source disposed within the internal space;

a light emitting diode (LED) housing supporting a plurality of LED panels, each LED panel supporting a plurality of LEDs;

a plurality of LED cooling fins extending from a back face of the LED housing; and an extension member extending from the back face of the LED housing to the power housing; and wherein the LED housing including the plurality of LED cooling fins are rotatable with respect to the power housing, wherein rotation maintains the plurality of LED panels substantially horizontal.

24. The high mast luminaire of claim 23 wherein multiple LEDs of the plurality of LEDs correspond to the same LED cooling fin.

25. A high mast luminaire, comprising:

a power housing defining an internal space and an aperture configured to receive a high mast extension member to support the high mast luminaire atop a mast;

a plurality of drivers disposed within the internal space;

a light emitting diode (LED) housing supporting a plurality of LED panels each supporting a plurality of LEDs;

a plurality of LED cooling fins extending from a back face of the LED housing; and an extension member extending between the power housing and the LED housing;

wherein the LED housing and the plurality of LED cooling fins are rotatable with respect to the power housing in a substantially horizontal plane to direct light from the plurality of LEDs to illuminate an area.

26. A high mast lighting system, comprising:

a mast;

a hub coupled to the mast and supporting a plurality of first extension members, each of the plurality of first extension members supporting a high mast luminaire disposed spaced apart from each other and disposed circumferentially about the mast, each high mast luminaire comprising:

a power housing defining an internal space and an aperture, a respective first extension member received by the aperture;

a power source disposed within the internal space;

a light emitting diode (LED) housing supporting at least one LED panel supporting a plurality of LEDs powered by the power source;

a plurality of LED cooling fins extending from a back face of the LED housing; and a second extension member extending between the power housing and the LED housing.

27. The high mast lighting system of claim 26 wherein for each high mast luminaire the LED housing including the plurality of LED cooling fins are rotatable with respect to the power housing and such rotation maintains the at least one LED panel substantially horizontal.

28. The high mast lighting system of claim 27 wherein for each high mast luminaire the LED housing is an outermost enclosure of all of the LEDs in a respective high mast luminaire.

29. A high mast luminaire, comprising:

a power housing defining an internal space and an aperture configured to receive a high mast extension member disposed atop a mast;

a plurality of power housing cooling fins extending from the power housing;

a plurality of drivers disposed within the internal space;

a light emitting diode (LED) housing supporting a first LED panel comprising a first plurality of LEDs and a second LED panel comprising a second plurality of LEDs;

a plurality of LED cooling fins extending from a back face of the LED housing; and an extension member extending between the power housing and the LED housing;

wherein the LED housing including the plurality of LED cooling fins are rotatable with respect to the power housing in a substantially horizontal plane to direct light from the plurality of LEDs to illuminate an area.

30. The high mast luminaire of claim 29 wherein a first one of the plurality of drivers powers the first plurality of LEDs and a second one of the plurality of drivers powers the second plurality of LEDs.

* * * * *